US006905317B2

(12) United States Patent
Hirabayashi et al.

(10) Patent No.: US 6,905,317 B2
(45) Date of Patent: Jun. 14, 2005

(54) OIL PUMP APPARATUS

(75) Inventors: Katsumi Hirabayashi, Anjo (JP); Ichiro Kimura, Nagoya (JP); Hirotaka Kurita, Nagoya (JP)

(73) Assignee: Aisin Seiki Kabushiki Kaisha, Kariya (JP)

( * ) Notice: Subject to any disclaimer, the term of this patent is extended or adjusted under 35 U.S.C. 154(b) by 0 days.

(21) Appl. No.: 10/307,489

(22) Filed: Dec. 2, 2002

(65) Prior Publication Data

US 2004/0105765 A1 Jun. 3, 2004

(30) Foreign Application Priority Data

Nov. 29, 2001 (JP) ..... 2001-365194

(51) Int. Cl.[7] ..... F04B 41/00
(52) U.S. Cl. ..... 417/440; 417/307; 417/310
(58) Field of Search ..... 417/440, 310, 417/307

(56) References Cited

U.S. PATENT DOCUMENTS 3,842,937 A * 10/1974 Lippay et al. ..... 184/6.3
4,971,528 A * 11/1990 Hodgkins et al. ..... 417/310
5,759,013 A 6/1998 Miyazaki et al.
6,099,263 A * 8/2000 Bodzak et al. ..... 417/295
6,196,181 B1 * 3/2001 Pong ..... 123/195 R
6,685,441 B2 * 2/2004 Nam ..... 417/292
6,739,305 B2 * 5/2004 Takahara et al. ..... 123/196 R
6,739,828 B2 * 5/2004 Schneider ..... 415/1
2002/0114703 A1 * 8/2002 Bodzak ..... 417/62
2003/0113216 A1 * 6/2003 Draskovits et al. ..... 417/307
2003/0180160 A1 * 9/2003 Bodzak et al. ..... 417/310

FOREIGN PATENT DOCUMENTS

DE 42 41 873 A1 12/1992
FR 2393956 A2 * 7/1977
FR 2 393 956 A2 6/1999

* cited by examiner

*Primary Examiner*—Cheryl Tyler
*Assistant Examiner*—Emmanuel Sayoc
(74) *Attorney, Agent, or Firm*—Reed Smith LLP; Stanley P. Fisher, Esq.; Juan Carlos A. Marquez, Esq.

(57) ABSTRACT

An oil pump apparatus includes a body, a first rotor and a second rotor disposed in the body so as to be able to rotate and a regulator valve mechanism for regulating the pressure of oil discharged to portions of an engine, wherein the regulator valve mechanism is disposed in the inside of the body and the engine and includes a regulator valve member which moves in the direction being in parallel with a rotation as of the first and second rotors in response to the discharged oil pressure.

4 Claims, 2 Drawing Sheets

OIL PUMP APPARATUS

The present application is based on and claims priority under 35 U.S.C §119 with respect to Japanese Patent application No. 2001-365194 filed on Nov. 29, 2001, the entire content of which is incorporated herein by reference.

FIELD OF THE INVENTION

The present invention relates to an oil pump apparatus and more particularly to an oil pump apparatus which includes a regulator valve mechanism for regulating discharged oil pressure.

BACKGROUND OF THE INVENTION

A conventional oil pump apparatus of this kind is disclosed, for example, in Japanese Utility-Model Laid-Open Publication No. 1-125806 and Japanese Utility-Model Laid-Open Publication No. 4-006510. The oil pump include a regulator valve mechanism which regulates the pressure of oil discharged from a discharge port to portions of an engine. In general, the oil pump apparatus is mounted at the front side of the engine and it is necessary to avoid an interference with a timing chain or an oil pump driving chain and so on when the oil pump is mounted. In such circumstance, the oil pump apparatus disclosed in the former publication has the regulator valve mechanism which is disposed on a body and which is projected outward from the body so as to avoid the interference with the timing chain. Therefore, the side of the oil pump is increased and the oil pump takes up lots of space for mounting on the engine. In the later publication, the regulator valve mechanism is disposed in a discharge passage of an engine block for avoiding the interference with the chain. In this oil pump, however, it is necessary to form ribs for preventing the generation of in order to achieve the foregoing object, the present invention provides an oil pump apparatus which includes a body, a first rotor and a second rotor disposed in the body so as to be able to rotate and a regulator valve mechanism for regulating the pressure of oil discharged to portions of an engine, wherein the regulator valve mechanism is disposed in the inside of the body and the engine and includes a regulator valve member which moves in the direction being in parallel with a rotation axis of the first and second rotors in response to the discharged oil pressure.

BRIEF DESCRIPTION OF THE DRAWINGS

The above and other objects, features and advantages of the present invention will be more apparent and more readily appreciated from the following detailed description of preferred exemplary embodiments of the present invention, taken in connection with the accompanying drawings, in which.

DETAILED DESCRIPTION OF THE PRESENT INVENTION

Figure 1:
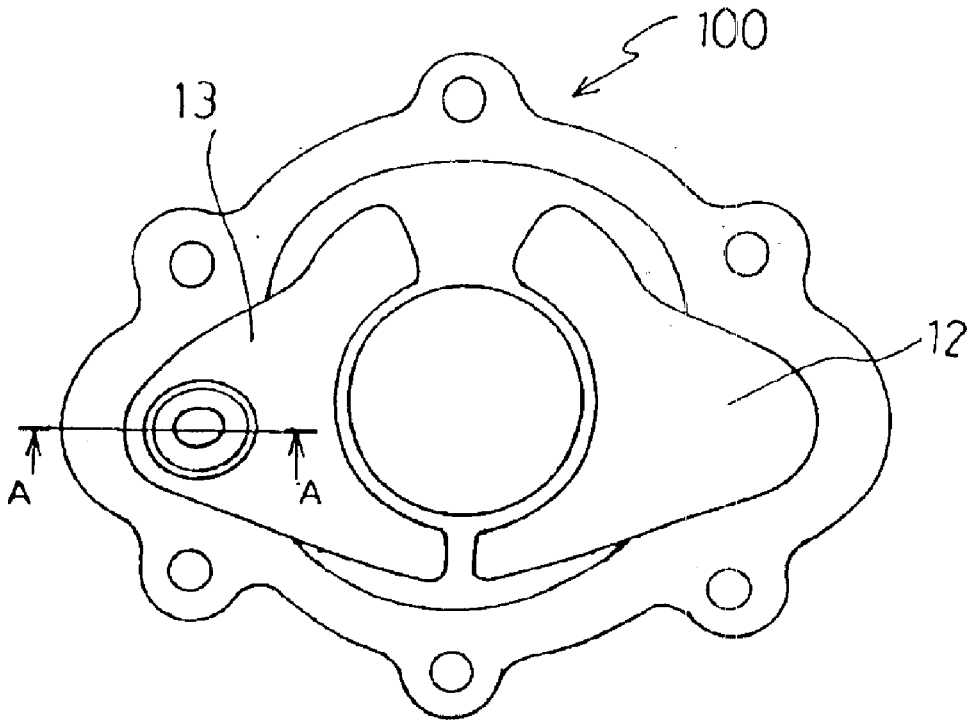
FIG. 1 is a front view of an oil pump apparatus according to a first embodiment of me present invention.
Figure 2:
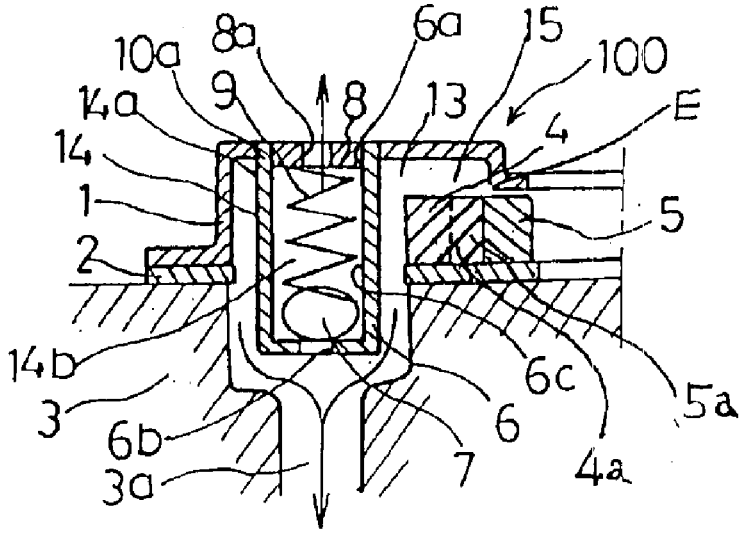
FIG. 2 is a cross-sectional view taken on line A—A of FIG. 1.

An oil pump apparatus in accordance with preferred embodiments of the present invention will be described with reference to attached drawings. FIGS. 1 and 2 show a first embodiment. The oil pump apparatus 100 is mounted on an end surface of a cylinder block 3 of an engine and an inner rotor 5 is fitted on a crank shaft (not shown). The oil pump apparatus 100 includes a body 1 which is made by press working of metal and which has a concave portion forming a pump chamber 15, a cover 2 which is made by press working of metal and which is secured to the body 1, the inner rotor 5 (corresponding to a first rotor) which is disposed in the pump chamber 15 defined by the body 1 and the cover 2 and which is able to rotate by a rotational driving force of the crank shaft and an outer rotor 4 (corresponding to a second rotor) which has inner teeth 4*a* engaged with outer teeth 5*a* of the inner rotor 5 and which is disposed in the pump chamber 15 so as to be rotated eccentrically with respect to the inner rotor 5; The outer rotor 4 is able to rotate by the inner rotor 5 through a tooth engagement E known to one skilled in the art. An inlet/suction port 12 and a discharge port 13 are formed on the body 1. When the inner rotor 5 is rotated by the crank shaft and the outer rotor 4 is rotated by the inner rotor 5, the oil pump apparatus 100 sucks oil which is stored in an oil pan (not shown) through the inlet port 12 and discharges oil under pressure to a discharge passage 3*a* of the cylinder block 3 through the discharge port 13. The oil discharged to the discharge passage 3*a* is supplied to portions of the engine for lubricating. The oil supplied to the portions of the engine is returned to the oil pan.

A regulator valve mechanism 14 which has an approximately cylindrical shape is disposed in the discharge port 13. The regulator valve mechanism 14 includes a cylindrical housing 6 having an outer diameter 14*a*, a plug 8, a ball member (corresponding to a regulator valve member) 7 and a spring 9. The cylindrical housing 6 is made by press working of metal and has a bottom portion at one end in the axial direction. At the other end of the housing 6, an opening portion 6*a* is formed and the plug 8 is securely fitted into the opening portion 6*a* so as to form a space 14*b* in the housing 6. The plug 8 has an exhaust hole 8*a*. At the bottom portion of the housing 6, a relief hole 6*b* is formed. The ball member 7 is normally urged by the spring 9 so as to close the relief hole 6*b*. The body 1 has a hole 10*a* and the housing 6 is pressed into the hole 10*a* so that the regulator valve mechanism 14 projects in the direction being in parallel with the rotors 5, 6. The regulator valve mechanism 14 projects into the discharge port 13 and the bottom portion of the housing 6 is accommodated in the opening of the discharge passage 3*a*. The relief hole 6*b* opens toward the discharge passage 3*a* and the exhaust hole 8*a* opens into the inside of timing chain cover (not shown).

When the pressure of the oil discharged to the discharge port 13 exceeds to a predetermined level, the ball member 7 moves against the spring 9 so as to open the relief hole 6*b*. Then, the oil under pressure is exhausted through the space 14*b* and the exhaust hole 8*a* and the pressure of the oil discharged to the discharge port 13 is regulated.

Figure 3:
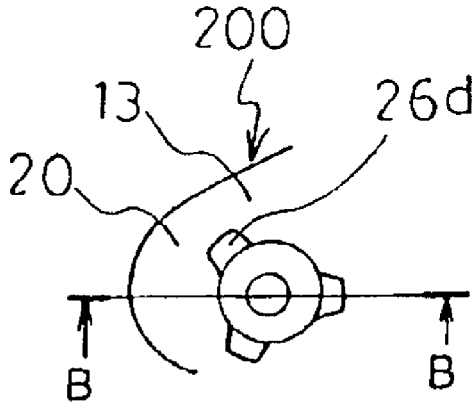
FIG. 3 is a front view of a regulator valve mechanism of an oil pump apparatus according to a second embodiment of the present invention.
Figure 4:
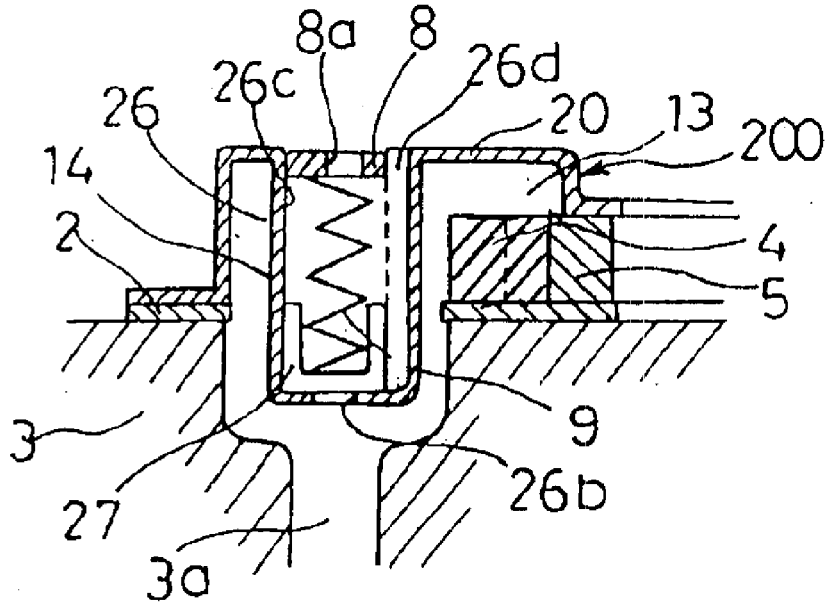
FIG. 4 is a cross-sectional view taken on line B—B of FIG. 3.

FIGS. 3 and 4 show a second embodiment. In this embodiment, a housing 26 of the regulator valve mechanism 14 is formed on the body 20 in a body by press working of metal. In the inner bore 26*c* of the housing 26, a plural oil exhaust grooves 26*d* are formed so as to arrange in the circumferential direction with a constant interval, respectively. Further, in the inner bore 26*c* of the housing 26, a piston valve 27 is silably disposed and is normally urged by the spring 9 so as to close a relief hole 26*b*. When the pressure of the oil discharged to the discharge port 13 exceeds to a predetermined level, the piston valve 27 moves against the spring 9 so as to open the relief hole 26*b*. Then, the oil under pressure is exhausted through the exhaust grooves 26*d*, the space 14*b* and the exhaust hole 8*a* and the pressure of the oil discharged to the discharge port 13 is regulated.

In the above embodiments, the oil pump apparatus includes the cover. However, it is able to abolish the cover. In this case, the pump chamber is defined by the body 1 and the end surface of the cylinder block 3. Further, the inlet port 12 and the discharge port 13 may be formed on the cylinder block 3. Further, it is able to apply the present invention to an external gear pump.

As mentioned above, according to the present invention, it is able to miniaturize an oil pump apparatus and it is able to avoid the interference with the timing chain and so on without increasing the size thereof.

What is claimed is:

1. An oil pump apparatus mounted on an engine block comprising:

a body having a pump chamber, a suction port and a discharge port;

a first rotor and a second rotor disposed in the pump chamber so as to be rotated by a shaft and rotate each other for pumping oil from the suction port to the discharge port;

a regulator valve mechanism for regulating the pressure of oil discharged to portions of an engine, the regulator valve mechanism including a regulator valve member which moves in the direction being in parallel with rotation axes of the first and second rotors in response to the discharged oil pressure; and a discharge passage formed in the engine block so as to fluidly communicate with the discharge port, wherein the discharge port and the discharge passage are located to be opposite each other so that the regulator valve mechanism is adapted to be disposed in both the discharge port and the discharge passage, the regulator valve mechanism is adapted to be disposed inside of the body and a cylinder block of the engine block, and the regulator valve mechanism comprises a cylindrical housing including an inner space, an opening formed at one end thereof, a bottom portion at the other end thereof, a relief hole formed on the bottom portion, a spring urging the regulator valve member accommodated in the inner space so as to close the relief hole as well as a plug for closing the opening and having an exhaust hole, wherein the regulator valve mechanism projects into the discharge port and the bottom portion of the housing is accommodated in the discharge passage.

2. An oil pump apparatus according to claim 1, wherein outer teeth of the first rotor engages with inner teeth of the second rotor.

3. An oil pump apparatus according to claim 1, wherein a hole is formed on the body so that the regulator valve mechanism is pressed into the hole.

4. An oil pump apparatus mounted on an engine block comprising:

a body having a pump chamber, a suction port and a discharge port;

a first rotor and a second rotor disposed in the pump chamber so as to be rotated by a shaft and rotate each other for pumping oil from the suction port to the discharge port;

a discharge passage formed in the engine block fluidlically communicating with and opposite to the discharge port; and a regulator valve mechanism disposed in the inside of the body and a cylinder block of the engine block for regulating the pressure of oil discharged to portions of an engine, the regulator valve mechanism including a regulator valve member which moves in the direction being in parallel with rotation axes of the first and second rotors, wherein the regulator valve mechanism comprises a cylindrical housing including an inner space, an opening formed at one end thereof, a bottom portion at the other end thereof, a bottom portion at the other end thereof, a relief hole formed on the bottom portion, a spring urging the regulator valve member accommodated in the inner space so as to close the relief hole as well as a plug for closing the opening and having an exhaust hole, wherein the regulator valve mechanism is disposed within the discharge port and the discharge passage, and the bottom portion of the housing is accommodated in the discharge passage.

* * * * *